US009179736B2

(12) United States Patent
Segel

(10) Patent No.: US 9,179,736 B2
(45) Date of Patent: Nov. 10, 2015

(54) ORTHOTIC FOR USE IN FOOTWEAR

(76) Inventor: Jerome D. Segel, West Tisbury, MA (US)

( * ) Notice: Subject to any disclaimer, the term of this patent is extended or adjusted under 35 U.S.C. 154(b) by 530 days.

(21) Appl. No.: 13/593,989

(22) Filed: Aug. 24, 2012

(65) Prior Publication Data

US 2012/0317838 A1 Dec. 20, 2012

Related U.S. Application Data

(63) Continuation of application No. 12/321,355, filed on Jan. 12, 2009, now abandoned.

(51) Int. Cl.

| | |
|---|---|
| ***A43B 13/38*** | (2006.01) |
| ***A43B 7/16*** | (2006.01) |
| ***A43B 7/22*** | (2006.01) |
| ***A43B 13/18*** | (2006.01) |
| ***A43B 17/02*** | (2006.01) |
| *A43B 13/14* | (2006.01) |

(52) U.S. Cl.

CPC ..... *A43B 13/183* (2013.01); *A43B 7/16* (2013.01); *A43B 17/02* (2013.01); *A43B 13/143* (2013.01); *A43B 13/148* (2013.01)

(58) Field of Classification Search

CPC .. A43B 13/143; A43B 13/145; A43B 13/146; A43B 13/148; A43B 7/1465; A43B 7/1415; A43B 7/22

USPC ..... 36/43, 44, 71, 140, 150, 154, 172, 36/161–165

See application file for complete search history.

(56) References Cited

U.S. PATENT DOCUMENTS

| | | | | | |
|---|---|---|---|---|---|
| 1,992,853 | A | * | 2/1935 | Barrett | 36/162 |
| 2,096,500 | A | * | 10/1937 | McCahan et al. | 36/144 |
| 2,207,833 | A | * | 7/1940 | Stark | 36/140 |
| 2,311,925 | A | * | 2/1943 | Boos | 36/163 |
| 2,401,514 | A | | 6/1946 | Scholl | |
| 2,441,891 | A | * | 5/1948 | Lucey et al. | 12/142 N |
| 2,518,033 | A | * | 8/1950 | Lucas | 36/163 |
| 3,859,740 | A | | 1/1975 | Kemp | |
| 4,517,981 | A | | 5/1985 | Santopietro et al. | |
| 4,686,993 | A | | 8/1987 | Grumbine | |
| 4,760,655 | A | * | 8/1988 | Mauch | 36/44 |
| 4,823,420 | A | | 4/1989 | Bartneck | |
| 4,910,884 | A | * | 3/1990 | Lindh et al. | 36/28 |
| 5,881,478 | A | * | 3/1999 | McMahon et al. | 36/144 |
| 6,098,319 | A | * | 8/2000 | Epstein | 36/159 |
| 6,247,250 | B1 | | 6/2001 | Hauser | |
| 6,543,158 | B2 | | 4/2003 | Dieckhaus | |
| 6,782,643 | B2 | * | 8/2004 | Brown | 36/144 |
| 6,817,115 | B2 | | 11/2004 | Polifroni | |
| 7,017,218 | B2 | | 3/2006 | Nguyen | |
| 7,334,351 | B2 | * | 2/2008 | Hann | 36/27 |
| 7,913,429 | B1 | * | 3/2011 | Wert | 36/159 |
| 2002/0050080 | A1 | | 5/2002 | Vasyli | |

* cited by examiner

*Primary Examiner* — Jila M Mohandesi

(57) ABSTRACT

An orthotic is disclosed. The orthotic has a convex element that has a periphery. The convex element is positioned in a plane. The periphery is structured and arranged to deform into a gap in at least of a horizontal, a vertical, or a lateral direction relative to the plane. The convex element is structured and arranged for placement between a plantar surface of a foot and a second surface. The gap is defined by a top surface of the convex element and a bottom surface of the foot or a bottom surface of a body of an insert. The periphery of the convex element is structured and arranged to deform into the gap as a force is applied to the body and to rebound as the force dissipates.

1 Claim, 8 Drawing Sheets

ORTHOTIC FOR USE IN FOOTWEAR

CROSS REFERENCE TO RELATED APPLICATIONS

This application is a continuation-in-part of U.S. patent application Ser. No. 12/321,355, filed on Jan. 12, 2009, and incorporated herein by reference.

BACKGROUND

In a gait cycle, the foot optimally goes through pronation and supination. When either of these tri-plane motions is made in excess, the foot is subject to biomechanical maladies with these excess deviations from its neutral position. Additionally, the foot in stance is subject to ground force reaction which often is the cause of foot deformity. However, conventional orthotics fail to actively manage motion in the horizontal, vertical, and lateral planes of motion during gait or in stance and therefore do not efficiently adjust to ground forces, stabilize the foot, or assist in propulsion during propulsion.

SUMMARY

In an embodiment, an orthotic is disclosed. The orthotic has a convex element that has a periphery. The convex element is positioned in a plane. The periphery is structured and arranged to deform into a gap in at least of a horizontal, a vertical, or a lateral direction relative to the plane. The convex element is structured and arranged for placement between a plantar surface of a foot and a second surface. The gap is defined by a top surface of the convex element and a bottom surface of the foot or a bottom surface of a body of an insert.

In another embodiment, an insert adapted to be used in footwear is disclosed. The insert has a body having a proximal end, a distal end, a top surface shaped to receive a plantar surface of a foot, a bottom surface, and a raised arch positioned on a medial side. A concave heel portion is formed in the top surface of the body at the proximal end of the body and is shaped to receive a heel of the foot. An orthotic having a convex element having a periphery is attached to the bottom surface of the body at the proximal end of the body substantially below the concave heel portion. There is a gap defined by the bottom surface of the body and a top surface of the convex element. The periphery of the convex element is structured and arranged to deform into the gap as a force is applied to the body and to rebound as the force dissipates. In an embodiment, the convex element has a parabolic proximal end and a cut-out at a distal end that forms medial and lateral members, wherein the medial and lateral members are structured and arranged to deform into the gap as the force is applied to the body and to rebound as the force dissipates.

In another embodiment, an insert adapted to be used in footwear is disclosed. The insert has a body having a proximal end, a distal end, a top surface shaped to receive a plantar surface of a foot, a bottom surface, and a raised arch positioned on a medial side. A concave heel portion formed in the top surface at the proximal end is shaped to receive a heel of the foot. An orthotic having a convex element having a periphery is attached to a bottom surface of the body at the distal end of the body proximal to the raised arch. A gap is defined by the bottom surface of the body and a top surface of the convex element. The periphery of the convex element is structured and arranged to deform into the gap as a force is applied to the body and to rebound as the force dissipates. In an embodiment, the convex element has a parabolic proximal end and a cut-out at a distal end that forms medial and lateral members, wherein the medial and lateral members are structured and arranged to deform into the gap as the force is applied to the body and to rebound as the force dissipates.

In another embodiment, an article of footwear is disclosed. The footwear has an upper having an opening that extends to an interior cavity that is structured and arranged to receive a foot. A sole structure is secured to the upper and is positioned below the opening. The sole structure has a proximal end, a distal end, a top surface positioned within the opening, and an opposite bottom surface. The footwear has an insert structured and arranged for positioning within the interior cavity. The insert has a body having a proximal end, a distal end, a top surface shaped to receive a plantar surface of the foot, a bottom surface structured and arranged to oppose the top surface of the sole structure, and a raised arch positioned on a medial side. There is a concave heel portion formed in the top surface of the body of the insert at the proximal end that is shaped to receive a heel of the foot. An orthotic having a convex element having a periphery is attached to the bottom surface of the body of the insert. A gap is defined by the bottom surface of the body and a top surface of the convex element. The periphery of the convex element is structured and arranged to deform into the gap as a force is applied to the body and to rebound as the force dissipates.

Other objects, features, aspects and advantages of the orthotic insert will become better understood or apparent from the following detailed description, drawings, and appended claims.

DETAILED DESCRIPTION

As shown generally in the figures, embodiments of an orthotic device 100 are disclosed. In certain embodiments, in use the orthotic 100 may be inserted into footwear 500 and worn between the plantar aspect of a foot and a top surface of a shoe or in-shoe appliance such as an insole, foot bed, or heel cup, referred to collectively herein as a removable insole or insert 200, described below. In certain embodiments, the orthotic 100 may directly contact the plantar surface of the foot in use. In certain embodiments, the orthotic 100 and the body of the insert may be unitary.

The orthotic 100 is configured to assist the musculoskeletal system in the responsive management of a triplane motion at the foot and ankle by repositioning the foot and providing motion control while dynamically absorbing shock. The deformable periphery of the orthotic provided graded adaptation to uneven surfaces and measured management of ground force reaction. The orthotic 100 is active at the stance phase, early in the gait cycle, and side to side motion, and rebounds to its original position later in the gait cycle, which stabilizes and propels the foot actively forward and provides for improved timing and foot mechanics compared to other orthotics.

Figure 1A:
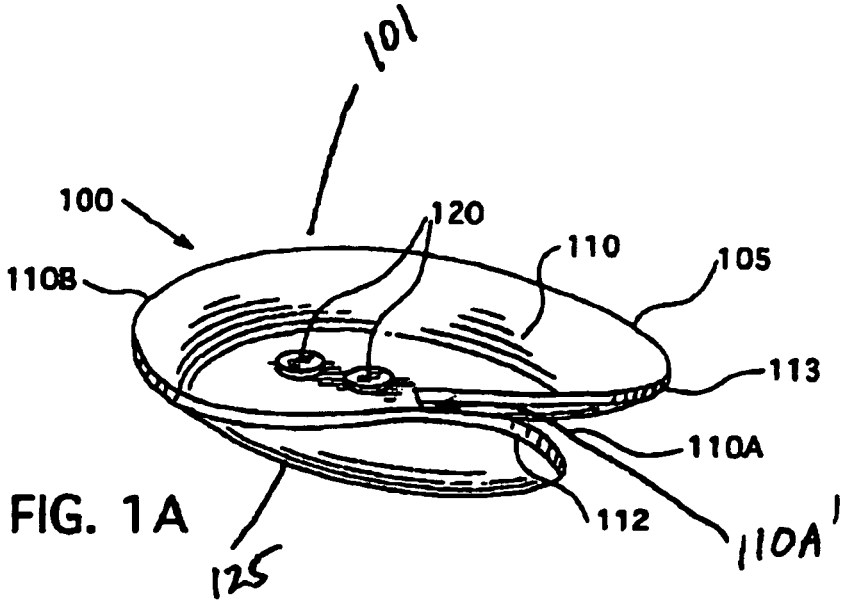
FIG. 1A illustrates a top isometric view of an embodiment of an orthotic.
Figure 1B:
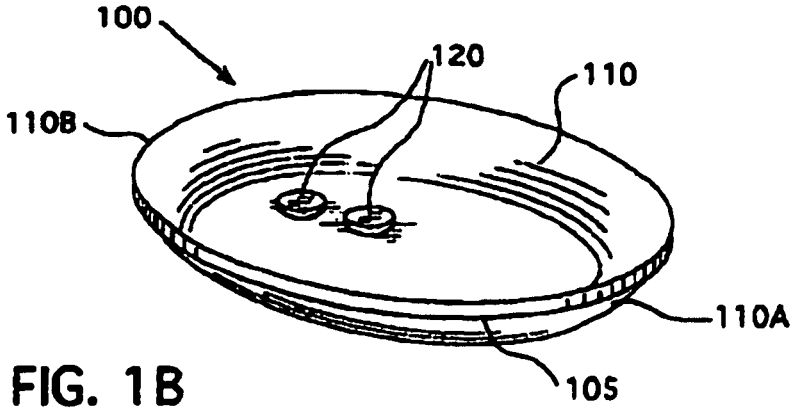
FIG. 1B illustrates a top isometric view of another embodiment of an orthotic.
Figure 2A:
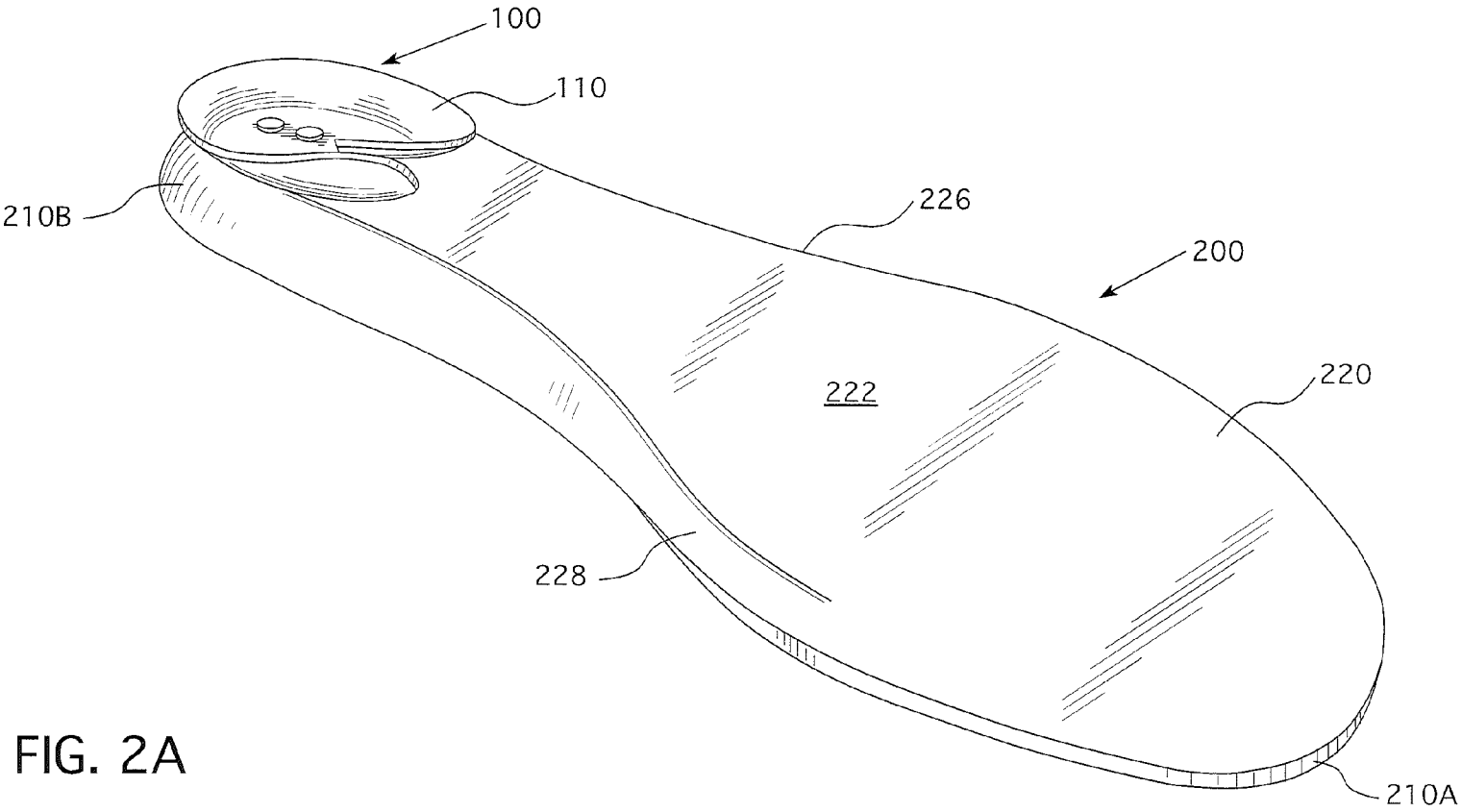
FIG. 2A illustrates a bottom isometric view of the orthotic illustrated in FIG. 1A attached to an embodiment of an insert for use in footwear.
Figure 2B:
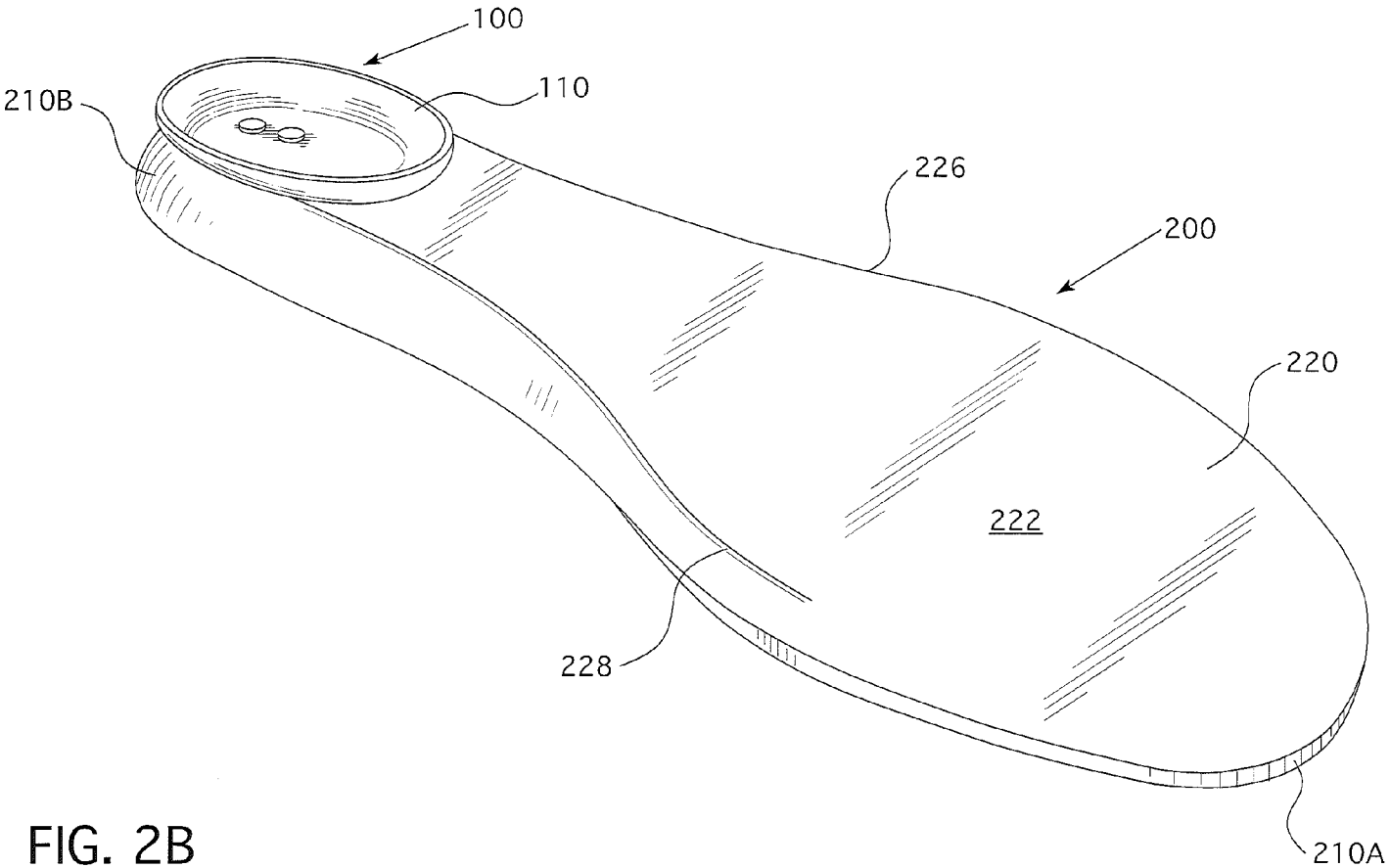
FIG. 2B illustrates a bottom isometric view of the orthotic illustrated in FIG. 1B attached to an embodiment of an insert for use in footwear.

As illustrated generally in the figures and particularly in FIGS. 1A and 1B, the orthotic 100 has a convex element 110 positioned in a plane. The periphery 105 of the convex element 110 is deformable and is structured and arranged to deform and rebound in use, as described in greater detail below. In an embodiment illustrated in FIG. 1A, the orthotic 100 has a parabolic proximal end 110A with a cut-out 110A' and a parabolic distal end 110B. The cut-out forms a medial member 112 and a lateral member 113. Each member 112, 113 has a periphery that is deformable and is structured and arranged to deform and rebound in use, as described in greater detail below. In another embodiment illustrated in FIG. 1B, the orthotic 100 has a parabolic proximal end 110A and a parabolic distal end 110B. In certain embodiments, the orthotic 100 has fasteners 120 that fasten or attach the orthotic to a bottom surface 222 of the body 220 of the insert 200, described below. In certain embodiments, the convex element 110 may be formed of an injected molded plastic, wood, fibers, composites, metals, polymers, graphite, or the like.

As illustrated in FIGS. 2 through 8, in certain embodiments, the orthotic device 100 may be attached to a removable insole or insert 200. The removable insole or insert 200 has a body 220 and a concave heel portion 230. The orthotic device 100 is positioned adjacent to the removable insole or insert 200 below a bottom surface of the body 220.

As illustrated in FIGS. 2 through 8, the removable insole or insert 200 has a body 220. The body 220 has a proximal end 210A and a distal end 210B, a top surface 225 and a bottom surface 222, and a medial side 226 and a lateral side 228. The top surface 225 is shaped to receive a plantar surface of a foot and may substantially contour to a shape of the foot. A raised arch 230 is positioned on the medial side 226 of the body 220. In the embodiments illustrated in FIGS. 2 through 7, the body 220 may be configured to extend substantially over a width and a length of a foot, although in other embodiments such as the one illustrated in FIG. 8, the body 220 may be configured to extend over only a portion of the length of the foot. In embodiments such as the one illustrated in FIGS. 2 through 7, the distal end 210B may be configured to be positioned about 1 cm to about 12 cm proximal to the metatarsal heads. In certain embodiments, the distal end 210B may be configured to end proximal to the metatarsal heads. In embodiments such as the one illustrated in FIG. 8, the proximal end 210A is configured to begin substantially near the longitudinal arch and to extend, in certain embodiments, up to about 10 mm proximal to the metatarsal heads in order to manage forefoot motion at the transverse arch during the terminal phase of gait. In an embodiment, the body 220 may be substantially rigid, resiliently rigid, or accommodative to movement. In an embodiment, the body 220 may be formed of an injected molded plastic, wood, fibers, composites, metals, polymers, graphite, and the like.

Figure 3:
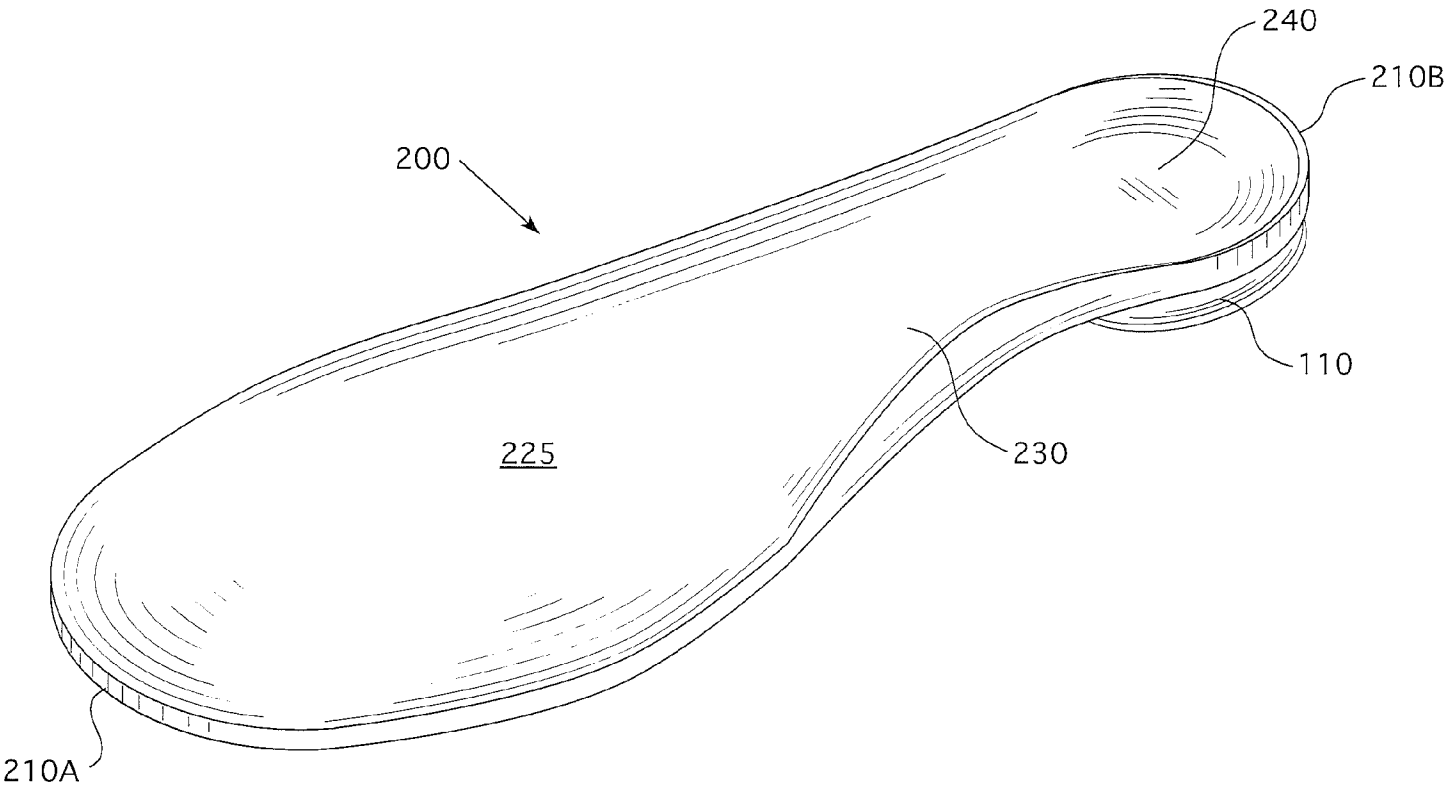
FIG. 3 illustrates a top isometric view of the orthotic attached to the insert illustrated in FIG. 2A.

As illustrated in FIG. 3, the insert 200 has a concave heel portion 240 formed in the top surface 225 of the body 220 at the proximal end 210A of the body 220. In embodiments, the concave heel portion 240 may be shaped to receive a heel of the foot. In embodiments, the concave heel portion 240 may have a depth that ranges from about 4 mm to about 18 mm.

Figure 4:
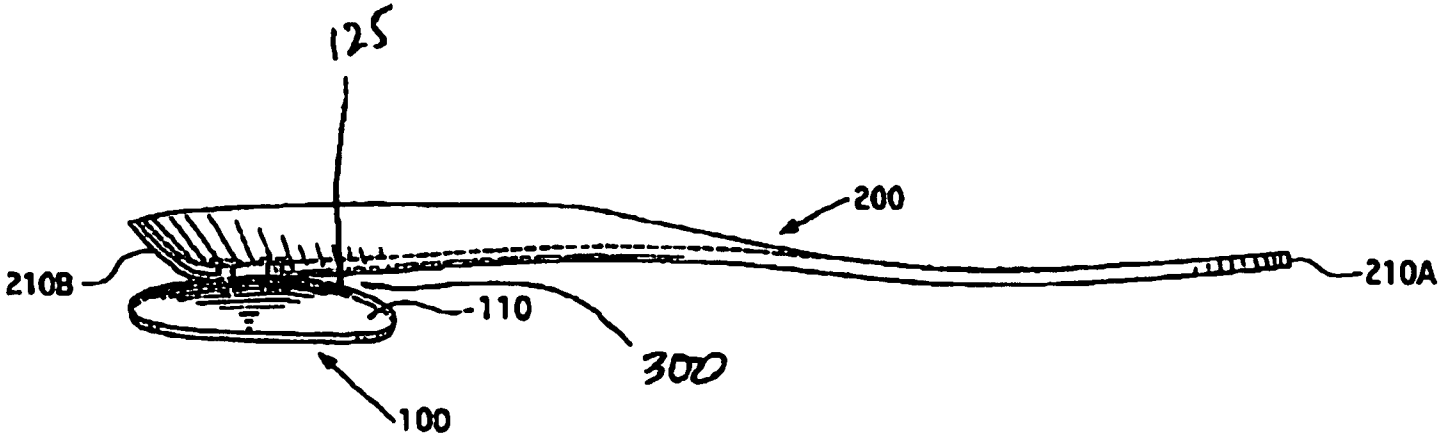
FIG. 4 illustrates a side view of the orthotic attached to the insert illustrated in FIG. 2A.
Figure 5:
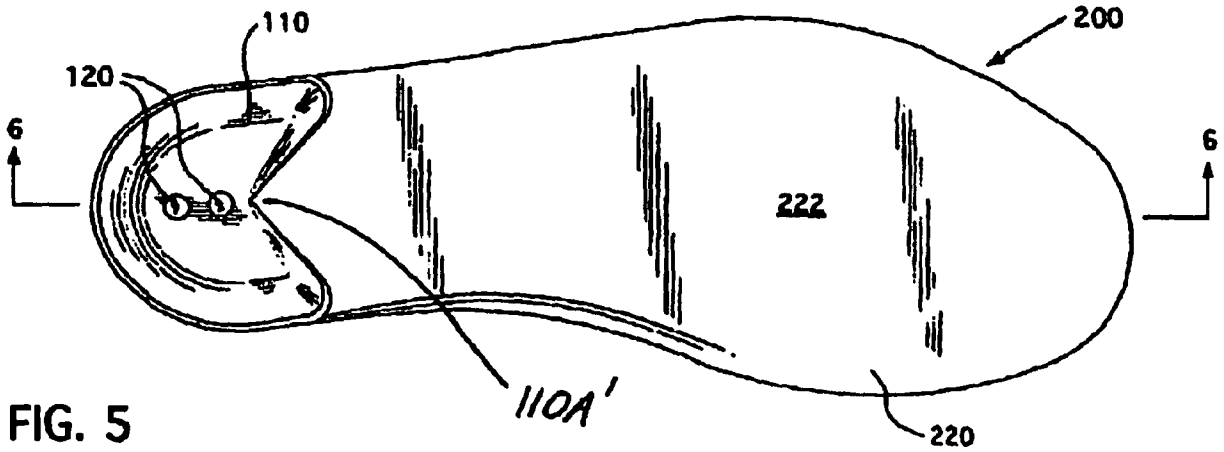
FIG. 5 illustrates a bottom view of the orthotic attached to the insert illustrated in FIG. 2A.
Figure 6:
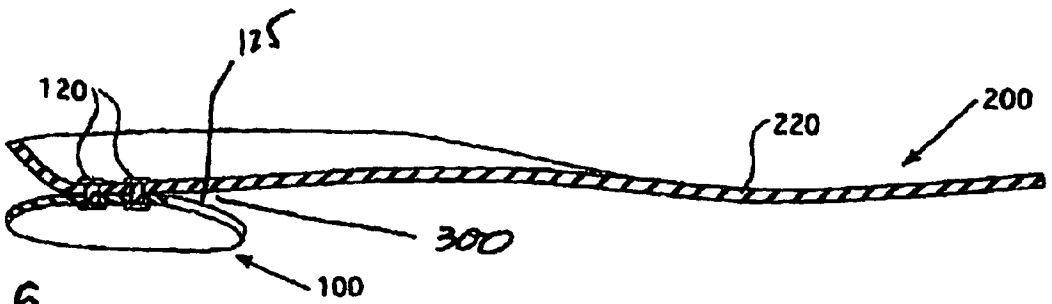
FIG. 6 illustrates a cross-sectional view of the orthotic attached to the insert illustrated in FIG. 2A and taken along line 6-6 in FIG. 5.

As illustrated in FIG. 4, a gap 300 is defined by the bottom surface 222 of the body 220 of the insert 200 and a top surface 125 of the convex element 110 of the orthotic 100. The periphery 105 of the convex element 110 is structured and arranged to deform into the gap 300 as a force is applied to the body 220 and to rebound as the force dissipates. The orthotic 100 provides a graded adaptation to uneven surfaces and a measured management of ground force reaction. The periphery 105 of the convex element 110 is structured and arranged to rebound as the force dissipates, thereby resupinating the foot for early stability and efficient propulsive phase of gait. In use, the convex element 110 functions as a shock absorber and provides medial and lateral motion control, energy return, proprioceptive cuing, and dynamic resupination of the foot.

The orthotic 100 may be positioned anywhere along the body 220 of the insert 200. In an embodiment illustrated in FIGS. 2 to 7, the orthotic 100 may be positioned at the proximal end 210A of the body 220 substantially below the concave heel portion 240 of the body 220. In an embodiment illustrated in FIG. 8, the convex element 110 may be positioned at the distal end 210B of the body 220 proximal to the raised arch 230.

Figure 7:
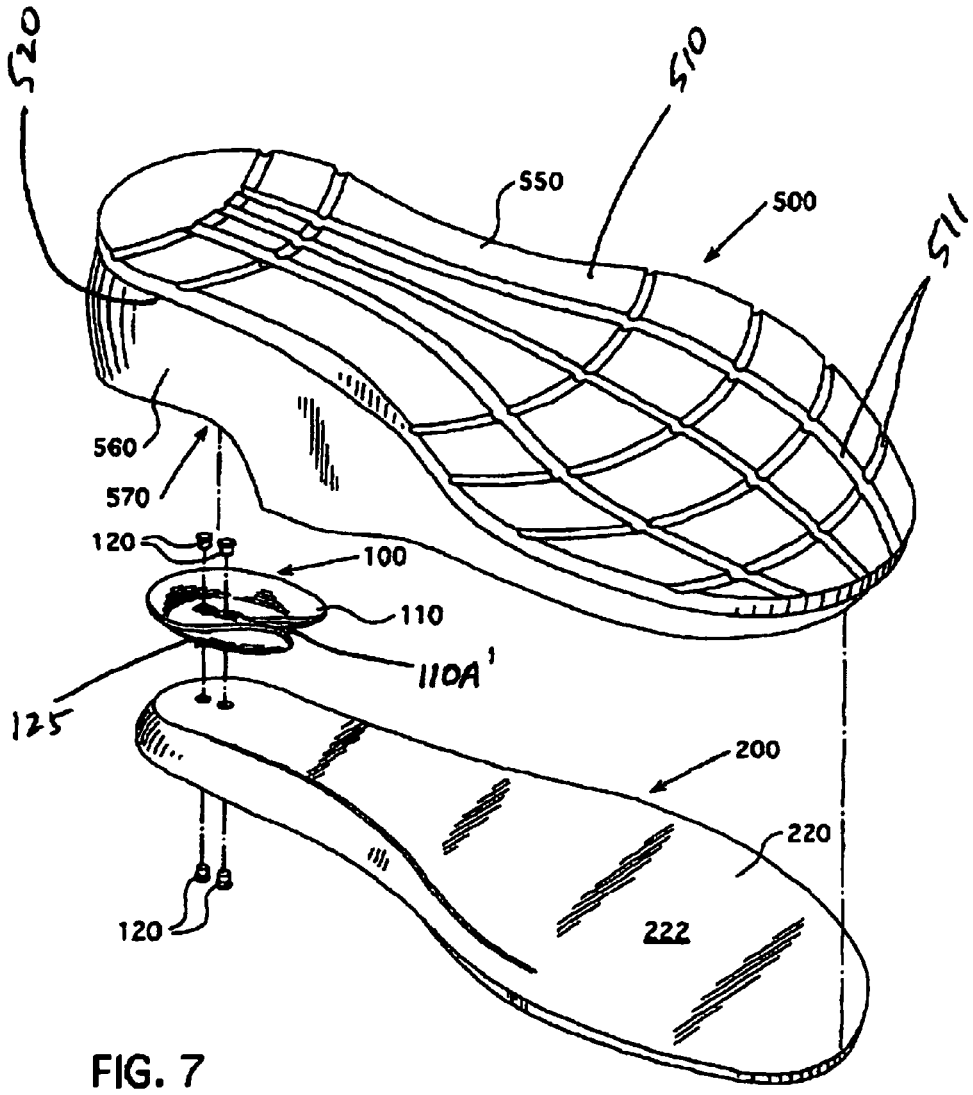
FIG. 7 illustrates an exploded detail view of the orthotic and the insert illustrated in FIG. 2A in combination with a shoe.
Figure 8:
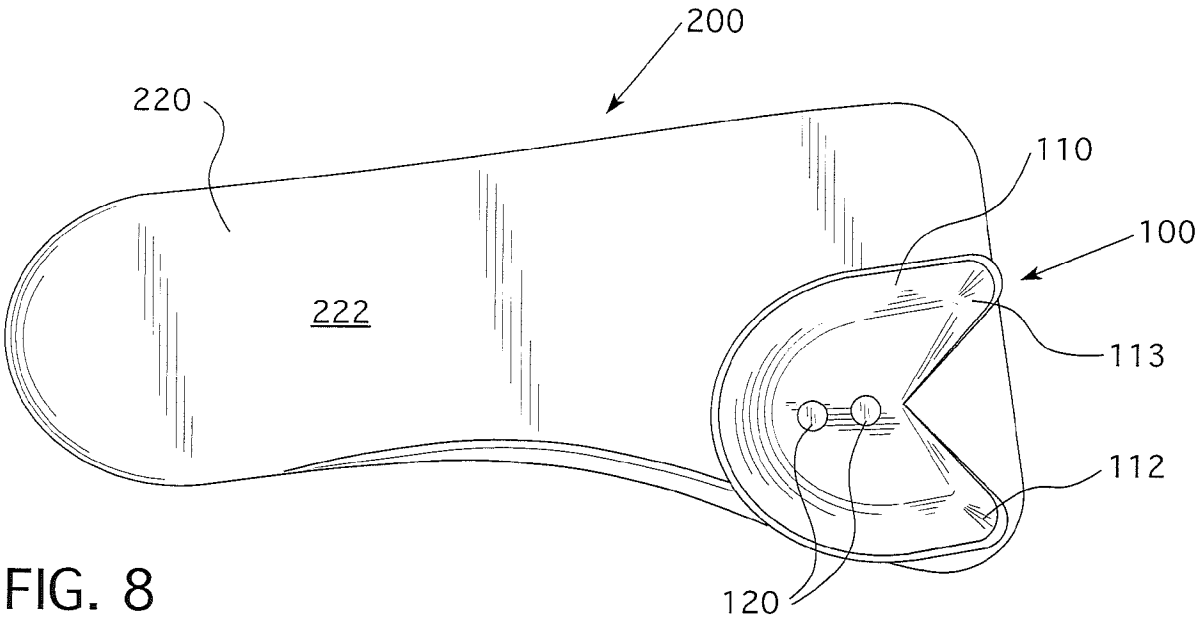
FIG. 8 illustrates a bottom view of the orthotic illustrated in FIG. 1A attached to another embodiment of an insert for use in footwear.

In another embodiment, the orthotic 100 may be adapted for use in footwear 500. An embodiment of an article of footwear 500 in combination with the orthotic 100 and an insert 200 is illustrated in FIG. 7. The footwear 500 may have an outsole 550 and an upper 560. The outsole 550 having an outer surface 510 for engaging the ground when the footwear is being used and an opposite inner surface 520, the outer surface 510 further includes threads 511 for providing traction. The upper 560 has an opening 570, and the upper 560 is attached to the outsole 550, wherein the upper in combination with the outsole 550 and the opposite inner surface 520 form an interior cavity 580, the opening 570 extends to the interior cavity 580 that is configured to receive a foot of a user. The outsole 550 is secured to the upper 560 and is positioned below the opening 570. The outsole 550 has proximal and distal ends 550A, 550B, a top surface 525 positioned within the interior cavity 580 of the upper 560, and an opposite bottom surface 522. In use, the orthotic device 100 may be positioned in the interior cavity 580 of the footwear 500 on the top surface 525 of the outsole 550. Optionally, the orthotic device 100 may be attached to a removable insole 200. The removable insole 200 is inserted and positioned entirely within the interior cavity 580, the removable insole 200 has a body 220, the body 220 has a proximal end 210A, a distal end 210B, a top surface 225, a bottom surface 222, a medial side 226 and a lateral side 228, the top surface 225 is shaped for receiving a plantar surface of the foot and substantially contoured to a shape of the foot, a raised arch 230 is positioned on the medial side 226 of the body 220, the removable insole 200 further includes a concave heel portion 240 formed in the top surface 225 at the proximal end 210A of the body 220.

Illustrating the invention are the following examples that are not to be considered as limiting the invention to their details.

EXAMPLE

Twenty three (23) subjects were tested. Each subject was without acute or inhibiting symptoms or pathologies. Each subject received an appropriate size commercially available orthotic (designated herein as "L") and an orthotic such as the one illustrated in FIG. 2A, having the convex element attached to the bottom surface substantially below the concave heel portion (designated herein as "D"). The orthotics (L and D) were made of either a composite material (designated herein as "C") or a plastic material (designated herein as "P").

Testing was performed on Noraxon's FDM-T treadmill (force distribution measurement treadmill) for stance and gait analysis. The FDM-T treadmill controls speed and the walking surface and also measures temporal and special gait parameters, kinetics, pressure and ground reaction forces complete and segmented.

Each subject completed a questionnaire that included questions regarding medical history, preexisting conditions or symptoms, and level of comfort with walking on a treadmill. Each subject was positioned on the FDM-T treadmill, the treadmill was calibrated and started. For each subject, the following protocol was followed:

(1) Wearing walking shoe without any orthotic inserts (designated herein as "R"):

a. Walk on treadmill for 60 seconds at 1.5 kilometers per hour. No data were recorded during this time period.
b. Then, record data while subject walks for an additional 30 seconds at 1.5 kilometers per hour (Dynamic Gait I—R).
c. Increase speed of treadmill to subject's speed of choice and walk on treadmill for 60 seconds. No data were recorded during this time period.
d. Then, record data while subject walks for an additional 30 seconds at the speed selected in step c above (Dynamic Gait II—R).

(2) Wearing walking shoes with an "L" orthotic insert made of either C or P:

a. Walk on treadmill for 60 seconds at 1.5 kilometers per hour. No data were recorded during this time period.
b. Then, record data while subject walks for an additional 30 seconds at 1.5 kilometers per hour (Dynamic Gait I—LC or LP).
c. Increase speed of treadmill to subject's speed of choice and walk on treadmill for 60 seconds. No data were recorded during this time period.
d. Then, record data while subject walks for an additional 30 seconds at the speed selected in step c above (Dynamic Gait II—LC or LP).
e. Then, record data while subject steps laterally (Lateral Side-Step—LC or LP).

(3) Wearing walking shoes with a "D" orthotic insert made of either C or P:

a. Walk on treadmill for 60 seconds at 1.5 kilometers per hour. No data were recorded during this time period.
b. Then, record data while subject walks for an additional 30 seconds at 1.5 kilometers per hour (Dynamic Gait I—DC or DP).
c. Increase speed of treadmill to subject's speed of choice and walk on treadmill for 60 seconds. No data were recorded during this time period.
d. Then, record data while subject walks for an additional 30 seconds at the speed selected in step c above (Dynamic Gait II—DC or DP).
e. Then, record data while subject steps laterally (Lateral Side-Step—DC or DP).

In each subject, data recorded with the D orthotic inserted into the shoes were compared to data recorded while the subject had the L orthotic inserted into the shoes. Data over subjects were averaged and are summarized below.

TABLE 1

Direct Comparisons Between D and L Orthotic Inserts

| Measurement | Increase/ Decrease (mm) Left Foot | Increase/Decrease (mm) Right Foot | Increase/Decrease (mm) Anterior, Posterior, Lateral |
|---|---|---|---|
| Average gait line | +5.17 | +4.35 | NA<br>NA |
| Average deviation in gait line length | −2.1 | −0.57 | NA |
| Average single support line | +3.9 | +2.09 | NA |
| Average deviation in single support line | −0.87 | −0.22 | NA |
| Average anterior/posterior position | NA | NA | +0.13 |
| Average anterior/posterior variation | NA | NA | −0.22 |
| Average lateral symmetry | NA | NA | +1.83 |
| Average lateral symmetry variation | NA | NA | −1.57 |

TABLE 2

Direct Comparisons Between D and L Orthotic Inserts

| Measurement | Increase/ Decrease Left Side | Increase/Decrease Right Side | Increase/ Decrease |
|---|---|---|---|
| Average foot abduction | −0.19° | −0.4° | |
| Average step width | | | −0.31 cm |
| Average step length | +0.73 cm | +1.34 cm | |
| Average step time | +0.01 sec | +0.02 sec | |
| Average time in stance | +0.62% | 0.49% | |
| Average loading response | +0.68% | +0.40% | |
| Average single support | −0.51% | −0.58% | |
| Average pre-swing | +0.5% | +0.61% | |
| Average swing phase | −0.62% | −0.49% | |
| Average total double support | | | +1.1% |
| Average stride length | | | +2.00 cm |
| Average stride time | | | +0.03 sec |
| Cadence | | | −1.82 steps/min |

These results indicate that stability and lateral movement are controlled by the orthotic insert having the convex element (D) so that there is less variability of center of pressure in all directions. Energy is stored and returned more efficiently so that strides are longer, more neutral in position, and loading responses are faster. Finally, resupination is faster, and preparation for propulsion to the next contact is faster.

During lateral stepping, an average increase of about 8 frames (8 ms) in lateral shift or pronation from a lateral supinated landing during the side step was measured in the D insert compared to the L insert. These data indicate that there was an increase in time to recenter after the supinated transversal motion.

When subjects used the D insert compared to the L insert, the center of pressure of a subject stepping laterally covered a smaller distance, indicating that even in the transversal plane, the D insert manages lateral motion and corrects the foot's position more effectively.

Additionally, when subjects wore the D insert compared to the L insert, there was a decrease in path length of the center of pressure, indicating that there was a smaller change in center of pressure with the D insert.

Finally, the average velocity (mm/sec) increased by 5.73 mm/sec when the subjects wore the D insert compared to the L insert.

While the foregoing has been set forth in considerable detail, it is to be understood that the drawings and detailed embodiments are presented for elucidation and not limitation. Design variations, especially in matters of shape, size and arrangements of parts may be made but are within the principles described herein. Those skilled in the art will realize that such changes or modifications of the invention or combinations of elements, variations, equivalents or improvements therein are still within the scope of the orthotic insert as defined in the appended claims.

I claim:

1. A footwear (500) used in combination with an orthotic device (100), the footwear comprising:

an outsole (550) having an outer surface (510) for engaging the ground when the footwear is being used and an opposite inner surface (520), the outer surface (510) further includes threads (511) for providing traction;

an upper (560) having an opening (570), the upper (560) is attached to the outsole (550), wherein the upper in combination with the outsole (550) and the opposite inner surface (520) form an interior cavity (580), the opening (570) extends to the interior cavity (580) that is configured to receive a foot of a user;

a removable insole (200) inserted and positioned entirely within the interior cavity (580), the removable insole (200) has a body (220), the body (220) has a proximal end (210A), a distal end (210B), a top surface (225), a bottom surface (222), a medial side (226) and a lateral side (228), the top surface (225) is shaped for receiving a plantar surface of the foot and substantially contoured to a shape of the foot, a raised arch (230) is positioned on the medial side (226) of the body (220), the removable insole (200) further includes a concave heel portion (240) formed in the top surface (225) at the proximal end (210A) of the body (220);

the orthotic device (100) is fastened to the bottom surface (222) of the body (220) of the removable insole (200), using a pair of fasteners (120), at the proximal end (210A) below the concave heel portion (240) of the body (220), the orthotic device (100) and the removable insole (200) are inserted and positioned entirely within the interior cavity (580) such that during use, the orthotic device (100) comes into direct contact with the opposite inner surface (520) of the outsole (550), wherein the orthotic device (100) provides a graded adaptation to uneven surfaces and a measured management of ground force reaction, the orthotic device (100) further consisting of: a convex element (110), a top surface (125) of the convex element (110), a periphery (105) of the convex element (110) structured and arranged to deform and rebound during use, a parabolic proximal end (110A) with a cut-out (110A') and a parabolic distal end (110B), the cut-out (110A') forms a medial member (112) and a lateral member (113), wherein each of the medial (112) and lateral (113) members structured and arranged to deform and rebound in use, wherein the convex element (110) functions as a shock absorber and provides medial and lateral motion control, energy return, proprioceptive cuing, and dynamic resupination of the foot in use; and a gap (300) is defined by the bottom surface (222) of the body (220) of the removable insole (200) and the top surface (125) of the convex element (110) such that during use, the periphery (105) of the convex element (110) is deformed into the gap (300) as a force is applied to the body (220) of the removable insole (200) and to rebound as the force dissipates.

* * * * *